US008453483B1

(12) United States Patent
Koo et al.

(10) Patent No.: US 8,453,483 B1
(45) Date of Patent: Jun. 4, 2013

(54) MAGNETIC PULSE FORMING DEVICE FOR ROLL FORMING SYSTEM AND CONTROL METHOD FOR THE SAME

(75) Inventors: Do-Hoi Koo, Suwon-si (KR); Su Jin Heo, Suwon-si (KR)

(73) Assignee: Sungwoo Hitech Co., Ltd., Pusan (KR)

( * ) Notice: Subject to any disclaimer, the term of this patent is extended or adjusted under 35 U.S.C. 154(b) by 0 days.

(21) Appl. No.: 13/325,349

(22) Filed: Dec. 14, 2011

(30) Foreign Application Priority Data

Nov. 24, 2011 (KR) ..... 10-2011-0123797

(51) Int. Cl.
*B21D 26/02* (2011.01)
*B21D 5/06* (2006.01)
*B23Q 17/00* (2006.01)

(52) U.S. Cl.
USPC ..... 72/56; 72/206; 72/207; 72/210; 72/430; 72/446; 72/707

(58) Field of Classification Search
USPC ..... 72/54, 56, 199, 206, 207, 210, 430, 72/446, 455, 707; 29/419.2, 715
See application file for complete search history.

(56) References Cited

U.S. PATENT DOCUMENTS

| | | | | |
|---|---|---|---|---|
| 4,320,645 | A * | 3/1982 | Stanley | 72/132 |
| 6,862,913 | B2 * | 3/2005 | Lempenauer et al. | 72/430 |
| 7,467,535 | B2 * | 12/2008 | Kuno et al. | 72/446 |
| 7,523,699 | B2 * | 4/2009 | Sakamoto | 100/43 |
| 7,752,880 | B2 * | 7/2010 | Sakamoto | 72/430 |
| 8,266,938 | B2 * | 9/2012 | Bradley et al. | 72/56 |
| 8,347,496 | B2 * | 1/2013 | Garner | 72/420 |

* cited by examiner

*Primary Examiner* — David B Jones
(74) *Attorney, Agent, or Firm* — Alston & Bird LLP

(57) ABSTRACT

A magnetic pulse forming device for a roll forming system includes forward and rearward guide rolling means, a guiding means including guiding rails disposed on the base between the forward and rearward guide rolling means and guide frames movably disposed on the guiding rails, a magnetic forming means including an upper plate connecting the guide frames corresponding to an upper surface of the forming beam, a coil housing assembled to the upper plate and a coil disposed within the coil housing and electrically connected to a pulse generator to generate a magnetic pulse by input current, a movement detector, a synchronizing motor connected to the lead screw to rotate the lead screw and a screw housing engaged with the lead screw and moving the guide frames with the forming beam in the process direction by rotation of the lead screw, and a forming mold.

18 Claims, 9 Drawing Sheets

MAGNETIC PULSE FORMING DEVICE FOR ROLL FORMING SYSTEM AND CONTROL METHOD FOR THE SAME

CROSS-REFERENCE TO RELATED APPLICATION

This application claims priority to and the benefit of Korean Patent Application No. 10-2011-0123797 filed in the Korean Intellectual Property Office on Nov. 24, 2011, the entire contents of which are incorporated herein by reference.

BACKGROUND OF THE INVENTION (a) Field of the Invention

The present invention relates to a magnetic pulse forming device for a roll forming system and a control method for the same. More particularly, the present invention relates to a magnetic pulse forming device for a roll forming system and a control method for the same that may form a bead portion for reinforcement using electromagnetic force.

(b) Description of the Related Art

A straight-type beam, such as a bumper beam, is manufactured by a roll forming apparatus including a plurality of roll formers that consist of an upper roller and a lower roller and are disposed in series. The roll formers bend a panel into various shapes.

FIG. 1 is a schematic diagram showing a conventional roll-forming system and respective steps of a roll-forming method using the same.

Referring to FIG. 1, a roll forming system includes an uncoiler 201 provided at a front portion in a process line and performing an uncoiling step S110 where a coil 210 is uncoiled.

A straightener 203 is provided at the rear of the uncoiler 201 in the process line and performs a straightening step S120 where the coil 210 supplied from the uncoiler 201 is straightened to be a panel 220.

In addition, the roll forming apparatus further includes a brake press 205 provided at the rear of the straightener 203 and performing a piercing step S130 where a plurality of holes for assembling a bumper beam are bored in the panel 220 supplied from the straightener 203.

A roll former unit 207 including a plurality of roll formers R1, R2, R3, R4, R5, R6, and R7 is provided at the rear of the brake press 205 in the process line. The roll former unit 207 performs a roll-forming step S140 by sequentially bending the panel 220 supplied through the uncoiler 201, the straightener 203, and the brake press 205 to be a predetermined-shaped beam 230 as shown in FIG. 2.

A round bender 209 including at least one of curvature-forming rolls disposed at both sides thereof is provided at the rear of the roll former unit 207 in the process line. The shaped beam, having gone through the roll-forming step S140, passes through the round bender 209 and is bent to have a predetermined curvature. Thereby, a bending step S150 is performed.

In addition, a cutting press 211 for cutting the shaped beam to have a predetermined dimension is provided at the rear of the round bender 209 in the process line, and performs a cutting step S160.

The above roll forming system and process may produce the formed beam 240 (shaped beam) as shown in FIG. 2, which may be a bumper beam 300 for a vehicle that is an open type along the length direction with a predetermined shape and bend.

However, a center portion of the bumper beam 300 may be weak to impact energy compared to both ends supported by a stay. Particularly, in a head-on collision, deformation of and damage to the center portion may be serious.

For reinforcing the center portion of the bumper beam, a reinforcing member may be provided to the center portion or a separate support beam may be applied thereto. However, an additional process is required and weight and manufacturing cost may be increased.

Thus, research and development for partially reinforcing the bumper beam in the roll forming process with a low cost and without increasing weight is required.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a roll forming system and a control method for the same having advantages of forming a reinforcement portion without affecting manufacturing cycle time in a rolling forming line.

Particularly, in an exemplary embodiment of the present invention, a magnetic pulse forming device for a roll forming system and a control method for the same may form a bead portion for reinforcement using electromagnetic force synchronized with roll forming speed.

A magnetic pulse forming device for a roll forming system according to an exemplary embodiment of the present invention may include forward and rearward guide rolling means disposed on a base and guiding movement of a forming beam, a guiding means including guiding rails disposed on the base between the forward and rearward guide rolling means and guide frames movably disposed on the guiding rails, a magnetic forming means including an upper plate connecting the guide frames corresponding to an upper surface of the forming beam, a coil housing assembled to the upper plate and a coil disposed within the coil housing and electrically connected to a pulse generator to generate a magnetic pulse by input current, a movement detector detecting movement of the forming beam, a synchronizing means including a lead screw disposed along the base, a synchronizing motor connected to the lead screw to rotate the lead screw and a screw housing engaged with the lead screw and moving the guide frames with the forming beam in the process direction by rotation of the lead screw, and a forming mold that is disposed on the screw housing through an ascending/descending cylinder corresponding to the magnetic forming means and that supports a lower surface of the forming beam and the forming mold to which a forming surface for forming a predetermined shape to the forming beam by the electromagnetic force generated from the coil is formed.

Each forward and rearward guide rolling means may include a roll frame disposed on the base, a lower guiding roller disposed to the roll frame through a slider and guiding the lower surface of the forming beam, and an upper guiding roller disposed to the roll frame through a slider and guiding the upper surface of the forming beam.

The guiding means further may include a slide block disposed on the guiding rail and vertically connected to the guide frame.

The magnetic forming means may further include a field shaper disposed near the coil and assembled to the coil housing for focusing the magnetic pulse on the upper surface of the forming beam.

A protrusion may be formed to the field shaper focusing the magnetic pulse to a forming portion.

The movement detector may include a rotating roller contacting the forming beam and rotating according to movement of the forming beam, and an encoder detecting the rotation of the rotating roller and outputting a rotation signal to a controller.

The rotating roller may be made of a rubber material.

The synchronizing means may further include a return switch that is disposed to the guiding rail, detects movement of the guide frame, and outputs a return signal to the controller.

The synchronizing motor may be a servo motor configured to control rotation speed and rotating direction.

The ascending/descending cylinder may be a hydraulic cylinder, and the forming mold may be disposed on an end of a rod that is raised or lowered by the operation of the ascending/descending cylinder.

A guide groove may be formed to the guide frame along up and down directions, and a guide protrusion may be formed to the forming mold to be guided along the guide groove.

A forming groove corresponding to the forming beam and having predetermined shape may be formed to the forming surface.

A control method for a magnetic pulse forming device for a roll forming system, the control method may include detecting rotation speed of a rotating roller according to movement of a forming beam from an encoder and a return signal from a return switch, calculating moving speed of the forming beam according to the rotation speed of the rotating roller, determining whether a current section of the forming beam is a forming section of the forming beam, raising a forming mold by operation of an ascending/descending cylinder and simultaneously operating a synchronizing motor forward for moving a magnetic forming means with the forming mold synchronized with moving speed of the forming beam if the current section of the forming beam is the forming section of the forming beam, controlling a pulse generator of the magnetic forming means to form and discharge a magnetic pulse to the forming beam using the magnetic pulse and the forming mold, detecting the return signal from the return switch and operating the ascending/descending cylinder to lower the forming mold and simultaneously controlling the synchronizing motor rearward for moving the magnetic forming means with the forming mold to the original position if the return signal is detected.

The magnetic forming means may include the pulse generator that discharges high voltage electrical energy stored to a condenser to generate pulse current, a coil housing disposed corresponding to the forming beam, a coil disposed within the coil housing and electrically connected to the pulse generator to generate a magnetic pulse by input current from the pulse generator, and a field shaper disposed near the coil and assembled to the coil housing for focusing the magnetic pulse on the upper surface of the forming beam.

The encoder may detect the rotation speed of the rotating roller according to the movement of the forming beam and output rotation speed signal to a controller.

The synchronizing motor may be controlled to rotate to move the magnetic forming means with the forming mold synchronized with the moving speed of the forming beam.

The synchronizing motor may be controlled to rotate to move the magnetic forming means with the forming mold synchronized with the moving speed of the forming beam.

The ascending/descending cylinder may be a hydraulic cylinder.

A roll forming system and a control method for the same according to the exemplary embodiment of the present invention may form a reinforced portion for reinforcement without affecting manufacturing cycle time in a rolling forming line with a low cost and without increasing weight.

<Description of Symbols>

Figure 1:
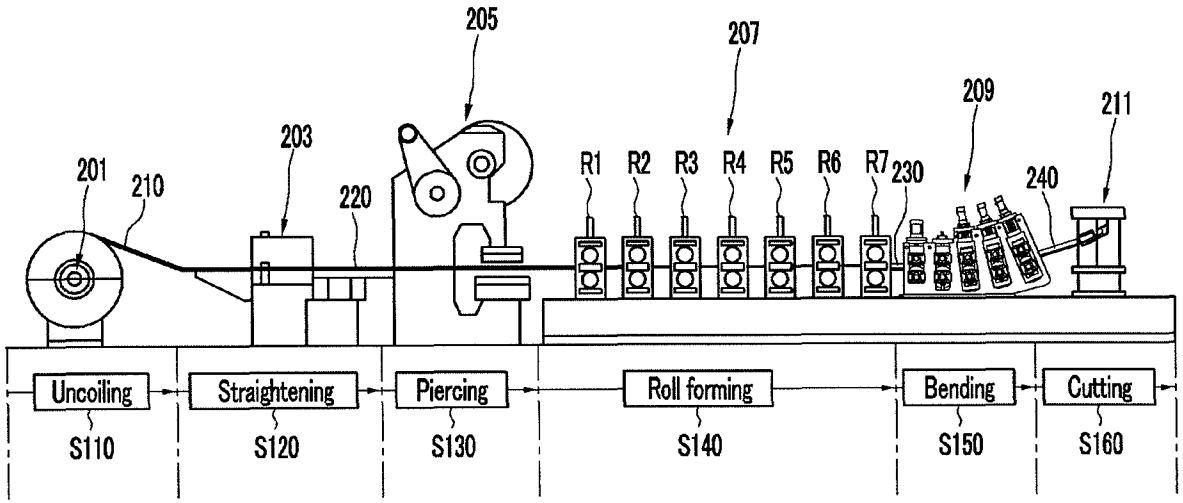
FIG. 1 is a schematic diagram showing a conventional roll-forming system and respective steps of a roll-forming method using the same.
Figure 2:
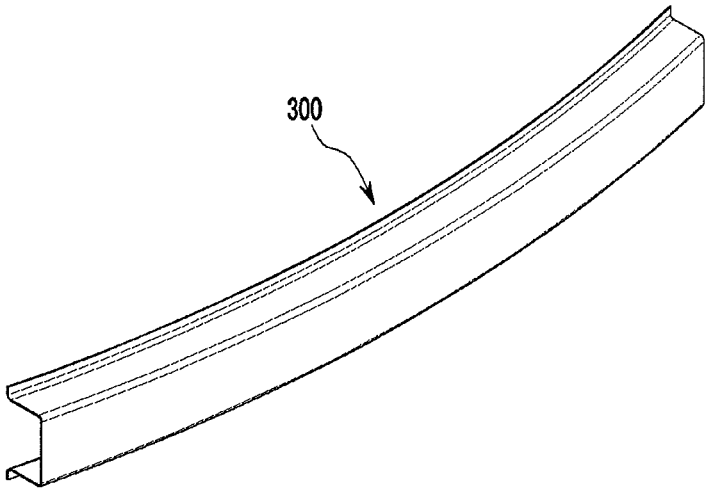
FIG. 2 is a perspective view of a bumper beam manufactured by a conventional roll forming apparatus and a method thereof.

| | | | |
|---|---|---|---|
| 1: | uncoiler | 2: | straightener |
| 3: | brake press | 4: | roll forming unit |
| 5: | magnetic pulse forming device | 6: | round bender |
| 7: | cutting press | 9: | base |
| 10: | coil | 20: | panel |
| 30, 40, 50, 60: | forming beam | 110, 120: | guide rolling means |
| 130: | guiding means | 140: | magnetic forming means |
| 150: | movement detector | 160: | synchronizing means |
| 170: | forming mold | 111, 121: | roll frame |
| 113, 123, 117, 127: | slider | 115, 125, 119, 129: | guiding roller |
| 131: | guiding rail | 133: | slide block |
| 135: | guide frame | 137: | upper plate |
| 141: | pulse generator | 143: | coil housing |
| 145: | coil | 147: | field shaper |
| 151: | rotating roller | 153: | encoder |
| 161: | screw housing | 163: | connecting bracket |
| 165: | lead screw | 167: | synchronizing motor |
| 169: | return switch | | |
| 171: | ascending/descending cylinder | | |
| 175: | guide groove | 177: | guide protrusion |
| V: | moving speed | C: | controller |

DETAILED DESCRIPTION OF THE EMBODIMENTS

Exemplary embodiments of the present invention will hereinafter be described in detail with reference to the accompanying drawings.

For better comprehension and ease of description, parts unrelated to explanation may be omitted, and like numerals refer to like elements throughout the specification. In the drawings, the thickness of layers, films, panels, regions, etc., are exaggerated for clarity.

Figure 3:
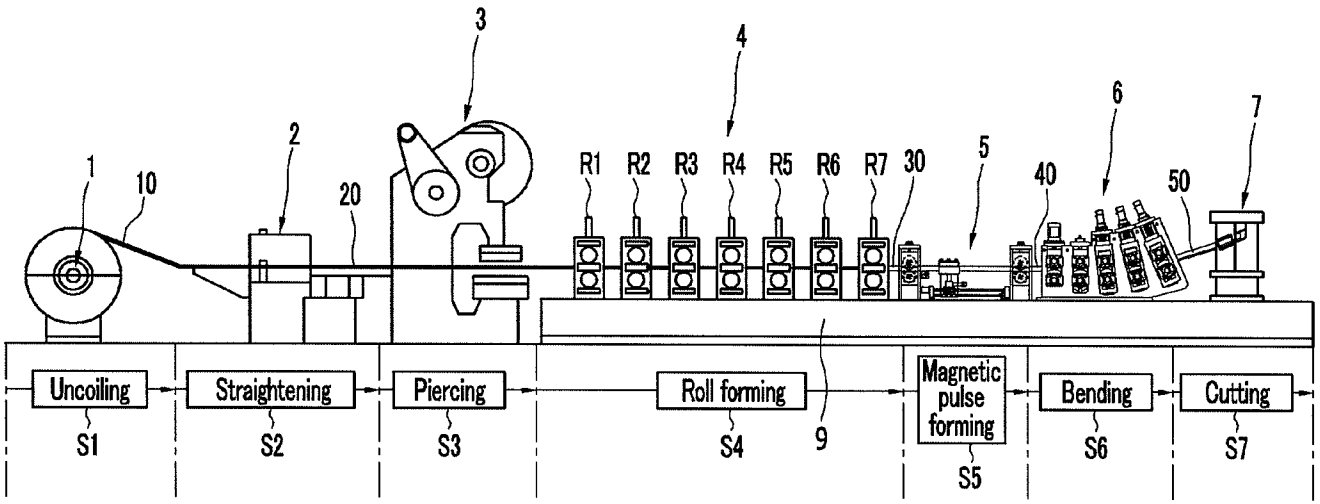
FIG. 3 is a schematic diagram of a roll forming apparatus to which a magnetic pulse forming device according to an exemplary embodiment of the present invention is applied and respective steps of a roll-forming method using the same.
Figure 4:
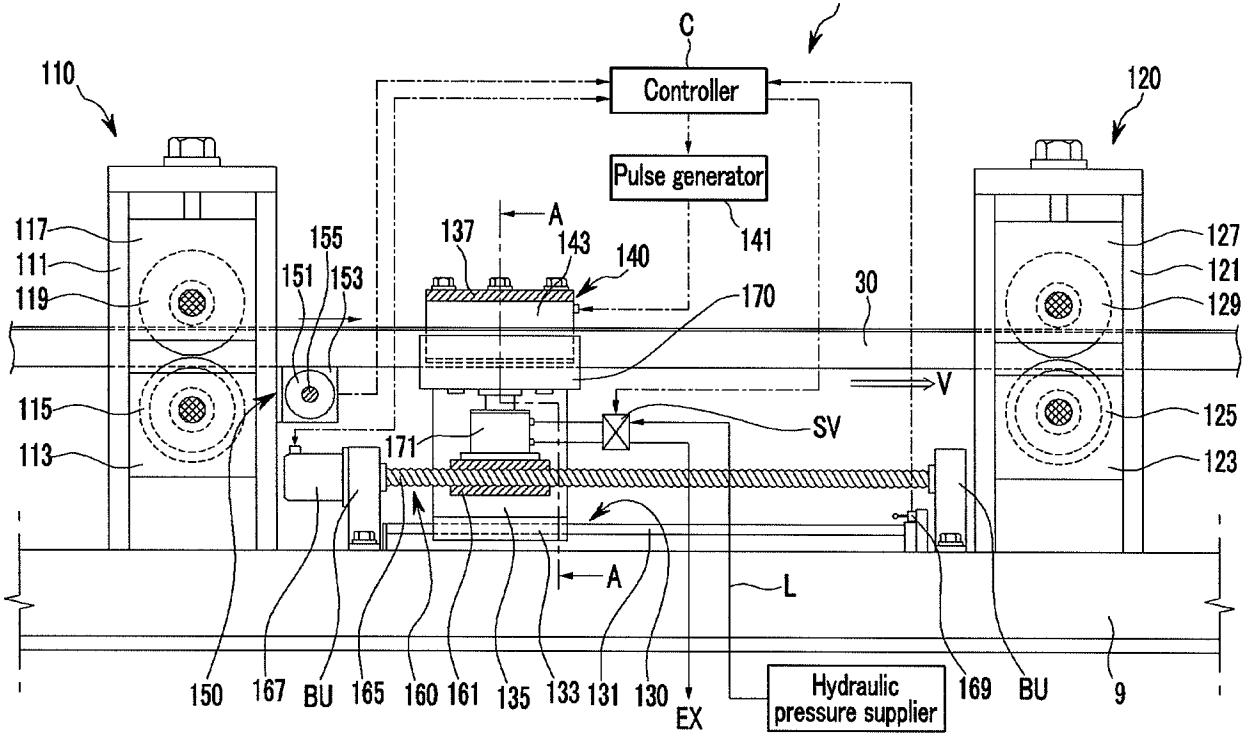
FIG. 4 is a side view of a magnetic pulse forming device according to an exemplary embodiment of the present invention.
Figure 5:
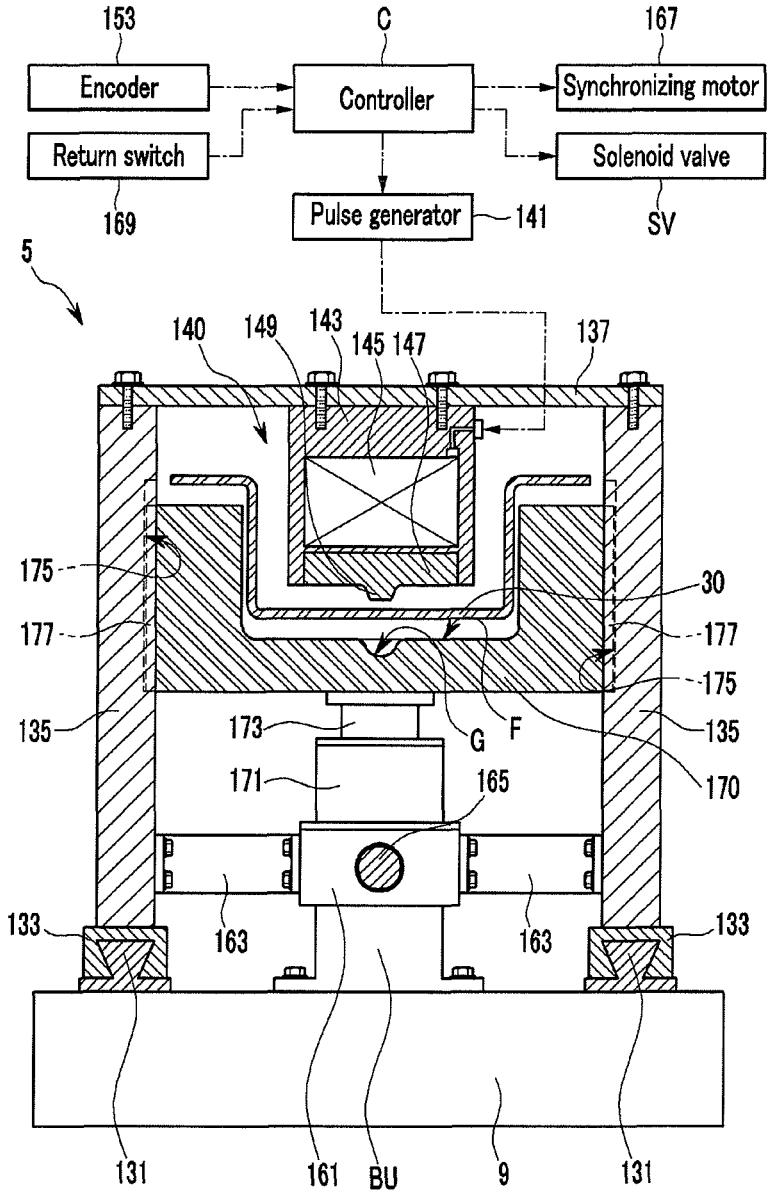
FIG. 5 is a cross-sectional view along line A-A of FIG. 4.

FIG. 3 is a schematic diagram of a roll forming apparatus to which a magnetic pulse forming device according to an exemplary embodiment of the present invention is applied and respective steps of a roll-forming method using the same, FIG. 4 is a side view of a magnetic pulse forming device according to an exemplary embodiment of the present invention, and FIG. 5 is a cross-sectional view along line A-A of FIG. 4.

Referring to FIG. 3, a magnetic pulse forming device 5 according to an exemplary embodiment of the present invention is provided at the rear of a roll forming unit including a plurality of roll formers R1, R2, R3, . . . , R6, and R7, and performs magnetic pulse forming to a forming beam (shaped beam) 30 with a predetermined shape.

A roll forming system to which the magnetic pulse forming device 5 according to an exemplary embodiment of the present invention may be applied includes an uncoiler 1 provided at a front portion in a process line, and a coil 10 is uncoiled from the uncoiler 1.

A straightener 2 is provided at the rear of the uncoiler 1 in the process line and straightens the coil 10 supplied from the uncoiler 1 to be a panel 20.

A brake press 3 is provided at the rear of the straightener 2 and pierces the panel 20 to form a plurality of holes for assembling a bumper beam supplied from the straightener 2.

A roll former unit 4 is provided at the rear of the brake press 3 in the process line. The roll former unit 4 sequentially bends the panel 20 supplied from the straightener 3 to be a predetermined-shaped beam (forming beam) 30.

The roll former unit 4 includes a plurality of roll formers R1, R2, R3, R4, R5, R6, and R7 disposed sequentially.

The magnetic pulse forming device 5 according to an exemplary embodiment of the present invention is provided at the rear of the roll forming unit 4, as shown in FIG. 4, to perform magnetic pulse forming of the forming beam 30.

A round bender 6 including at least one of curvature-forming rolls disposed at both sides thereof is provided at the rear of the magnetic pulse forming device 5 in the process line. A shaped beam (forming beam) 40, having passed through the round bender 6, is bent to have a predetermined curvature.

In addition, a cutting press 7 for cutting a shaped beam (forming formed beam) 50 to have a predetermined dimension is provided at the rear of the round bender 6.

Referring to FIG. 4 and FIG. 5, the magnetic pulse forming device 5 includes forward and rearward guide rolling means 110 and 120, a guiding means 130, a magnetic forming means 140, a movement detector 150, a synchronizing means 160, and a forming mold 170.

The forward and rearward guide rolling means 110 and 120 are disposed on the base 9 between the last roll former (i.e., R7 of FIG. 3) of the roll forming unit 4 and the round bender 6, and guides the forming beam 30.

The forward and rearward guide rolling means 110 and 120 may have the same function and scheme, and include a roll frame 111 and 121 disposed on the base 9, respectively.

Lower guiding rollers 115 and 125 are respectively disposed to lower portions of the roll frames 111 and 121 through respective sliders 113 and 123 to rotatably support a lower surface of the forming beam 30.

Upper guiding rollers 119 and 129 are respectively disposed to upper portions of the roll frames 111 and 121 through respective sliders 117 and 127 to rotatably support an upper surface of the forming beam 30.

The forward and rearward guide rolling means 110 and 120 guide the forming beam 30 that is roll-formed by the roll forming unit 4 at a constant speed through each of the upper and lower guiding rollers 119, 129, 115 and 125.

The upper and lower guiding rollers 119, 129, 115, and 125 may ease spring-back that may be generated by remaining residual stress in the roll forming process of the forming beam 30 and thus deformation may be prevented in the magnetic pulse forming process performed by the magnetic pulse forming device 5.

The guiding means 130 is disposed on the base 9 between the forward and rearward guide rolling means 110 and 120 along the process direction.

The guiding means 130 includes guiding rails 131 disposed along the process direction.

A slide block 133 is slidably disposed on each guiding rail 131 and a guide frame 135 is vertically disposed on each slide block 133.

An upper plate 137 connects upper portions of the guide frames 135.

The magnetic forming means 140 is disposed to the upper plate 137 corresponding to the upper surface of the forming beam 30, generates electromagnetic force using a high voltage current input from a pulse generator 141, and performs magnetic pulse forming using the electromagnetic force to the forming beam 30.

The pulse generator 141 discharges high voltage electrical energy stored to a condenser (not shown) to generate the pulse current.

A coil housing 143 is mounted to a lower portion of the upper plate 137 and a coil 145 is disposed within the coil housing 143.

The coil 145 is electrically connected to the pulse generator 141, and may be an induction coil used to generate the magnetic pulse using the pulse current input from the pulse generator 141.

A field shaper 147 is disposed near the coil 145 and assembled to the coil housing 143, and focuses the magnetic pulse on the upper surface of the forming beam 30.

A protrusion 149 may be formed to the field shaper 147 to integrally focus the magnetic pulse on a forming portion of the forming beam 30.

The movement detector 150 detects movement of the forming beam 30 for calculating moving speed of the forming beam 30 and determining whether a current section of the forming beam 30 is a forming section of the forming beam 30.

The movement detector 150 includes a rotating roller 151 that contacts the forming beam 30 and rotates around an encorder shaft 155 according to the movement of the forming beam 30, and an encoder 153 that detects the rotation of the rotating roller 151 and outputs the rotation signal.

The encoder 153 outputs the rotation speed signal of the rotating roller 151 according to the movement of the forming beam 30 to a controller C, and the controller C calculates the moving speed of the forming beam 30 and determines whether the current section of the forming beam 30 is the forming section of the forming beam 30.

The rotating roller 151 may be made of a rubber material, a resin such as silicon, and so on to enhance the contact characteristic.

The synchronizing means 160 is disposed between the guiding rails 131 on the base 9 and synchronizes movement of the guide frames 135 to the moving speed of the forming beam 30 along the process direction.

The synchronizing means 160 includes a screw housing 161 disposed between the guide frames 135, and the screw housing 161 is connected to the guide frame 135 through a connecting bracket 163.

The screw housing 161 is engaged with a lead screw 165, and both ends of the lead screw 165 are rotatably disposed to bearing units BU on the base 9.

A synchronizing motor 167 is disposed to one of the bearing units BU, and a rotation shaft of the synchronizing motor 167 is connected to the lead screw 165 to drive the lead screw 165.

The synchronizing motor 167 may be a servo motor configured to control rotation speed and rotating direction.

A return switch 169 is disposed to a rear portion of the guiding rail 131, detects the guide frame 135, and outputs a return signal to the controller C.

The forming mold 170 is disposed on an ascending/descending cylinder 171 that is disposed on the screw housing 161 corresponding to the field shaper 147 of the magnetic forming means 140.

The ascending/descending cylinder 171 may be a hydraulic cylinder using hydraulic pressure controlled by a solenoid valve SV disposed on a hydraulic pressure line L.

The forming mold 170 is disposed on an end of a rod 173, which ascends or descends by the operation of the ascending/descending cylinder 171, and ascends or descends between the guide frames 135.

The forming mold 170 has a forming surface F that supports the lower surface of the forming beam 30 when the coil 145 generates the electromagnetic force to perform the magnetic pulse forming to the forming beam 30, and a forming groove G is formed to the forming surface F with a predetermined shape corresponding to the lower surface of the forming beam 30.

A guide groove 175 is formed to each guide frame 135 along up and down directions, and guide protrusions 177 are formed to the forming mold 170 to be guided by the guide grooves 175.

Figure 6:
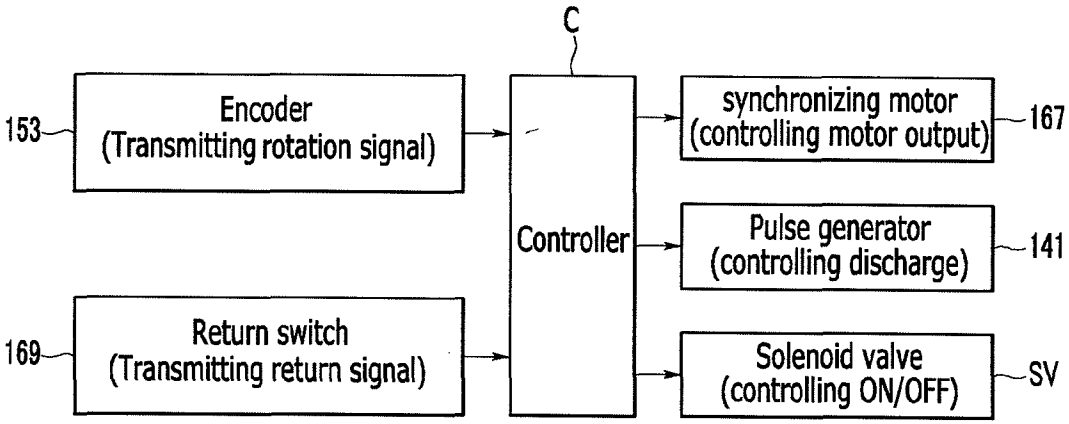
FIG. 6 is a control block diagram of a control method for a magnetic pulse forming device according to an exemplary embodiment of the present invention.

As shown in FIG. 6, the controller C receives the rotation speed signal of the rotating roller 151 from the encoder 153 and the return signal from the return switch 169, and calculates the moving speed V of the forming beam 30 according to the rotation speed signal and determines whether the current section of the forming beam 30 is the forming section of the forming beam 30, and determines synchronizing return time according to the return signal.

Also, the controller C controls the synchronizing speed of the magnetic forming means 140 by motor output control of the synchronizing motor 167, and controls discharging time of the pulse generator 141. The controller C controls operations of the ascending/descending cylinder 171 by controlling ON and OFF of the solenoid valve SV.

Hereinafter, referring to FIG. 3, operations of the magnetic pulse forming device 5 will be described.

The uncoiler 1 supplies the coil 10 at the initial process line to perform an uncoiling step S1.

After the uncoiling step S1, the straightener 2 provided at the rear of the uncoiler 1 straightens the coil 10 to become the panel 20 to perform a straightening step S2.

The brake press 3 provided at the rear of the straightener 2 performs a piercing step S3 where a plurality of holes for assembling the forming beam are bored in the panel 20 supplied from the straightener 2.

The roll former unit 4 including a plurality of roll formers R1, R2, R3, R4, R5, R6, and R7 provided at the rear of the brake press 3 in the process line performs a roll-forming step S4 by sequentially bending the panel 20 supplied through the brake press 3 to be the predetermined-shaped beam 30.

Figure 8:
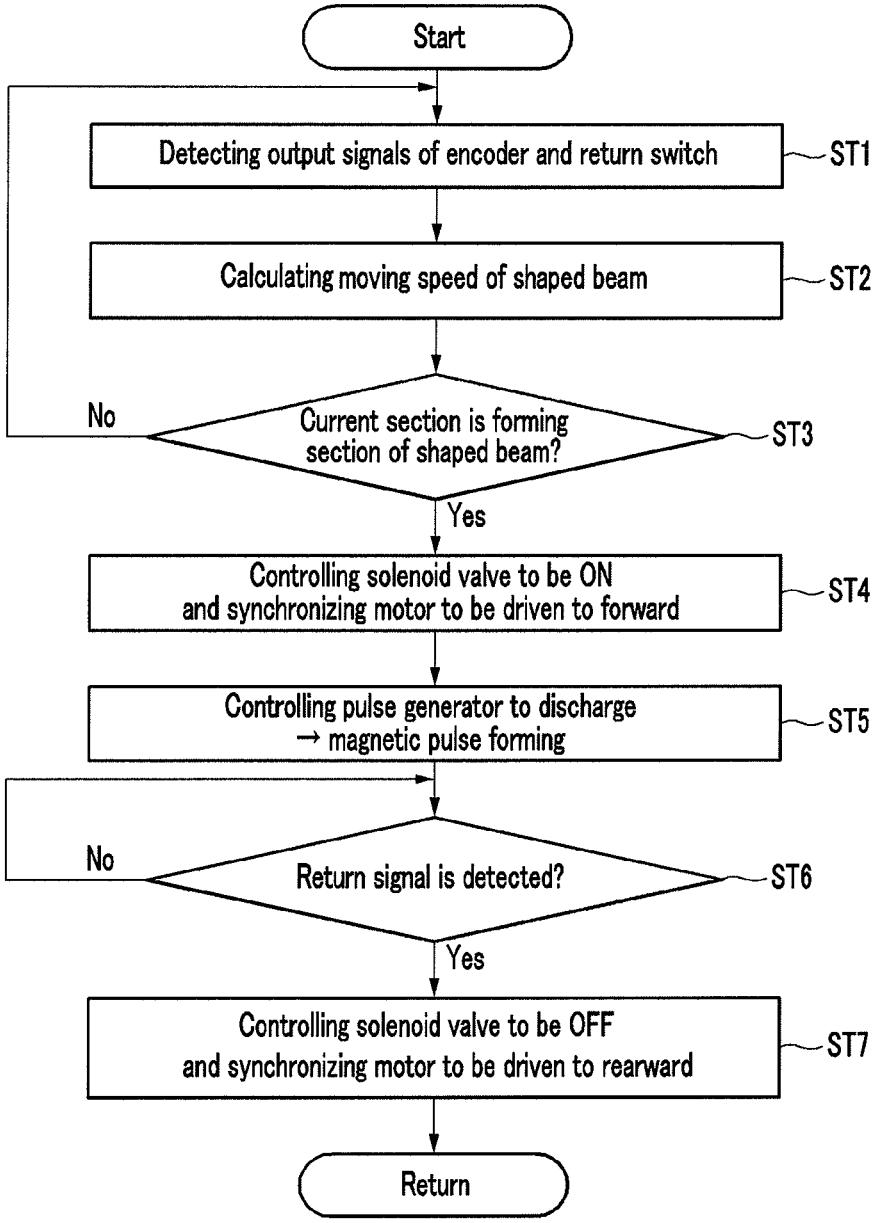
FIG. 8 is a flowchart of a control method for a magnetic pulse forming device according to an exemplary embodiment of the present invention.

The magnetic pulse forming device 5 provided at the rear of the roll forming unit 4 as shown in FIG. 4 and FIG. 5 performs a magnetic pulse forming step S5 according to the control method shown in FIG. 8 for forming a bead portion 61 for reinforcement while synchronizing the forming beam 30.

The round bender 6 provided at the rear of the magnetic pulse forming device 5 in the process line performs bending step S6 to bend the forming beam 40 be have a predetermined curvature.

Figure 9:
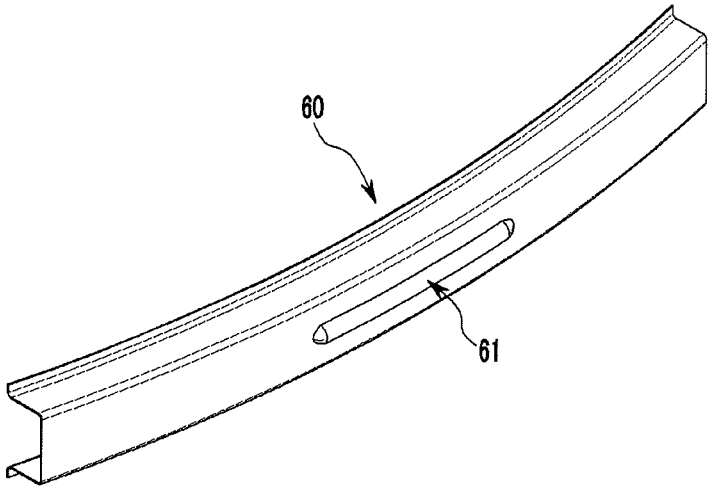
FIG. 9 is a perspective view of a bumper beam manufactured by a roll forming apparatus applied with a magnetic pulse forming device and a control method for the same according to an exemplary embodiment of the present invention.

The cutting press 7 provided at the rear of the round bender 6 performs cutting step S7 by cutting the forming beam 50 supplied from bending step S6 to have a predetermined dimension. Thus, as shown in FIG. 9, the bead 61 for reinforcement is formed to the center of the forming beam 60.

Hereinafter, a control method for the magnetic pulse forming device 5 according to an exemplary embodiment of the present invention will be described referring to FIG. 8.

The controller C receives the rotation speed signal of the rotating roller 151 from the encoder 153 and the return signal from the return switch 169 (ST1).

Then the controller C calculates the moving speed V of the forming beam 30 according to the rotation speed signal and determines a synchronizing return time according to the return signal (ST2).

The controller C determines whether the current section of the forming beam 30 is the forming section of the forming beam 30 (ST3).

If the current section of the forming beam 30 is not the forming section of the forming beam 30, it returns to step ST1.

If the current section of the forming beam 30 is the forming section of the forming beam 30, the controller C controls the solenoid valve SV to operate the ascending/descending cylinder 171 in order to raise the forming mold 170, and simultaneously the controller C controls the synchronizing motor 167 to move the magnetic forming means 140 with the forming mold 170 synchronized with the moving speed V of the forming beam 30 (ST4).

Figure 7:
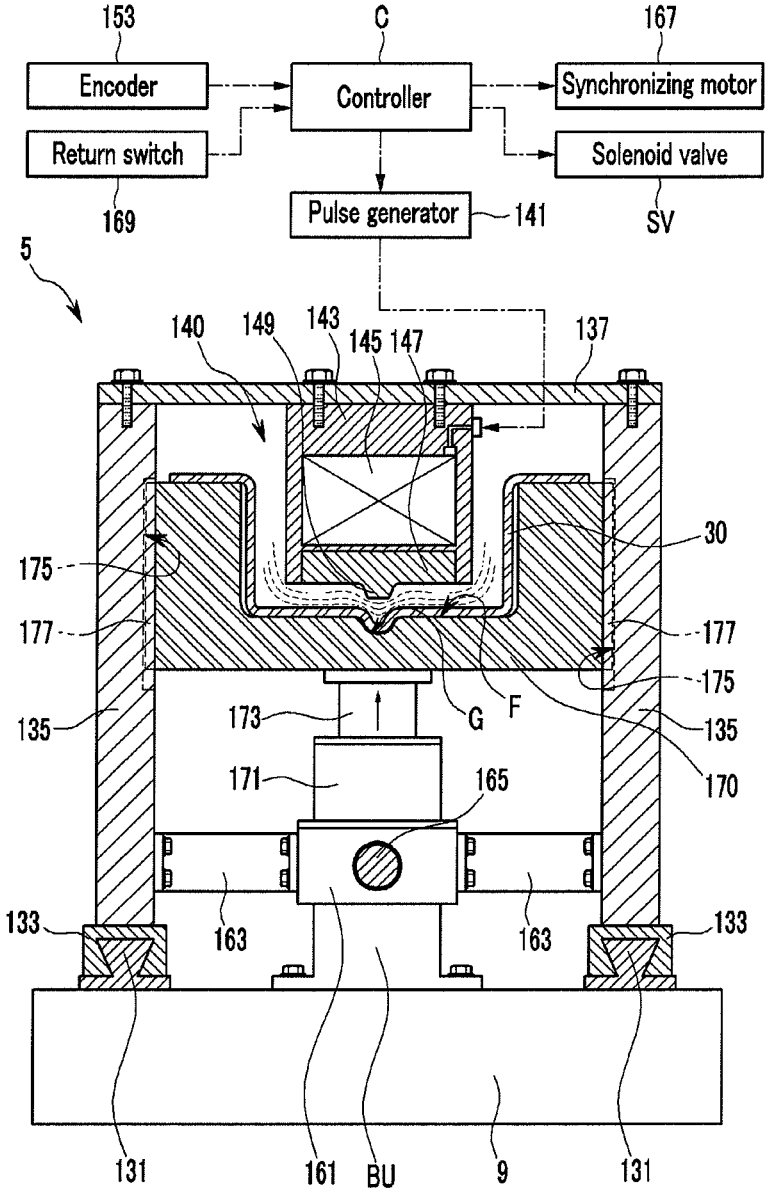
FIG. 7 is a drawing showing operations of a magnetic pulse forming device according to an exemplary embodiment of the present invention.

As shown in FIG. 7, the forming mold 170 ascends to contact the lower surface of the forming beam 30, and the magnetic forming means 140 and the forming mold 170 move along the process direction synchronized with the moving speed V of the forming beam 30.

Then, the controller C controls the pulse generator 141 of the magnetic forming means 140 to discharge high voltage electricity stored in the condenser (not shown) through the coil 145.

The magnetic pulse, as shown in FIG. 7, is then focused on the forming beam 30 through the field shaper 147 and performs the magnetic pulse forming (ST5).

The controller C then determines whether a return signal is detected from the return switch 169 (ST6)

If the controller C detects the return signal, the controller C controls the solenoid valve SV to operate the ascending/descending cylinder 171 in order to lower the forming mold 170, and simultaneously the controller C controls the synchronizing motor 167 to move the forming mold 170 with the magnetic forming means 140 to the original position (ST7).

As shown in FIG. 5, the forming mold 170 then descends to be separated from the lower surface of the forming beam 30, and the forming mold 170 and the magnetic forming means 140, as shown in FIG. 4, return along the opposite direction of the process to the original position.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A magnetic pulse forming device for a roll forming system, comprising:

forward and rearward guide rolling means disposed on a base and guiding movement of a forming beam;

a guiding means comprising guiding rails disposed on the base between the forward and the rearward guide rolling means and guide frames movably disposed on the guiding rails;

a magnetic forming means comprising an upper plate connecting the guide frames corresponding an upper surface of the forming beam, a coil housing assembled to the upper plate and a coil disposed within the coil housing and electrically connected to a pulse generator to generate a magnetic pulse by input current;

a movement detector detecting movement of the forming beam;

a synchronizing means comprising a lead screw disposed along the base, a synchronizing motor connected to the lead screw to rotate the lead screw, and a screw housing engaged with the lead screw and moving the guide frames with the forming beam in the process direction by rotation of the lead screw; and a forming mold that is disposed on the screw housing through an ascending/descending cylinder corresponding to the magnetic forming means and that supports a lower surface of the forming beam and the forming mold to which a forming surface for forming a predetermined shape to the forming beam by the electromagnetic force generated from the coil is formed.

2. The magnetic pulse forming device of claim 1, wherein each forward and rearward guide rolling means comprises:

a roll frame disposed on the base;

a lower guiding roller disposed to the roll frame through a slider and guiding the lower surface of the forming beam; and an upper guiding roller disposed to the roll frame through a slider and guiding the upper surface of the forming beam.

3. The magnetic pulse forming device of claim 1, wherein the guiding means further comprises a slide block disposed on the guiding rail and vertically connected to the guide frame.

4. The magnetic pulse forming device of claim 1, wherein the magnetic forming means further comprises a field shaper disposed near the coil and assembled to the coil housing for focusing the magnetic pulse on the upper surface of the forming beam.

5. The magnetic pulse forming device of claim 4, wherein a protrusion is formed to the field shaper focusing the magnetic pulse to a forming portion.

6. The magnetic pulse forming device of claim 1, wherein the movement detector comprises:

a rotating roller contacting the forming beam and rotating according to movement of the forming beam; and an encoder detecting the rotation of the rotating roller and outputting a rotation signal to a controller.

7. The magnetic pulse forming device of claim 6, wherein the rotating roller is made of a rubber material.

8. The magnetic pulse forming device of claim 1, wherein the synchronizing means further comprises a return switch that is disposed to the guiding rail, detects movement of the guide frame, and outputs a return signal to the controller.

9. The magnetic pulse forming device of claim 1, wherein the synchronizing motor is a servo motor configured to control rotation speed and rotating direction.

10. The magnetic pulse forming device of claim 1, wherein the ascending/descending cylinder is a hydraulic cylinder, and the forming mold is disposed on an end of a rod that is raised or lowered by the operation of the ascending/descending cylinder.

11. The magnetic pulse forming device of claim 1, wherein a guide groove is formed to the guide frame along up and down directions, and a guide protrusion is formed to the forming mold to be guided along the guide groove.

12. The magnetic pulse forming device of claim 1, wherein a forming groove corresponding to the forming beam and having a predetermined shape is formed to the forming surface.

13. A control method for a magnetic pulse forming device for a roll forming system, the control method comprising:

detecting rotation speed of a rotating roller according to movement of a forming beam from an encoder and a return signal from a return switch;

calculating moving speed of the forming beam according to the rotation speed of the rotating roller;

determining whether a current section of the forming beam is a forming section of the forming beam;

raising a forming mold by operation of an ascending/descending cylinder, and simultaneously operating a synchronizing motor forward for moving a magnetic forming means with the forming mold synchronized with moving speed of the forming beam if the current section of the forming beam is the forming section of the forming beam;

controlling a pulse generator of the magnetic forming means to form and discharge a magnetic pulse to the forming beam using the magnetic pulse and the forming mold;

detecting the return signal from the return switch; and operating the ascending/descending cylinder to lower the forming mold and simultaneously controlling the synchronizing motor rearward for moving the magnetic forming means with the forming mold to the original position if the return signal is detected.

14. The control method of claim 13, wherein the magnetic forming means comprising:

the pulse generator that discharges high voltage electrical energy stored to a condenser to generate a pulse current;

a coil housing disposed corresponding to the forming beam;

a coil disposed within the coil housing and electrically connected to the pulse generator to generate a magnetic pulse by input current from the pulse generator; and a field shaper disposed near the coil and assembled to the coil housing for focusing the magnetic pulse on the upper surface of the forming beam.

15. The control method of claim 13, wherein the encoder detects the rotation speed of the rotating roller according to the movement of the forming beam and outputs rotation speed signal to a controller.

16. The control method of claim 13, wherein the synchronizing motor is controlled to rotate to move the magnetic forming means with the forming mold synchronized with the moving speed of the forming beam.

17. The control method of claim 16, wherein the synchronizing motor is a servo motor configured to control rotation speed and rotating direction.

18. The control method of claim 13, wherein the ascending/descending cylinder is a hydraulic cylinder.

* * * * *